United States Patent [19]

Barr

[11] Patent Number: 4,694,919

[45] Date of Patent: Sep. 22, 1987

[54] ROTARY DRILL BITS WITH NOZZLE FORMER AND METHOD OF MANUFACTURING

[75] Inventor: John D. Barr, Cheltenham, England

[73] Assignee: NL Petroleum Products Limited, Gloucestershire, England

[21] Appl. No.: 821,303

[22] Filed: Jan. 22, 1986

[30] Foreign Application Priority Data

Jan. 23, 1985 [GB] United Kingdom ..... 8501702

[51] Int. Cl.[4] ..... E21B 10/60

[52] U.S. Cl. ..... 175/393; 175/409; 175/424; 76/108 A; 76/DIG. 11

[58] Field of Search ..... 175/393, 340, 409, 422 R; 76/108 A, 108 R, DIG. 11

[56] References Cited

U.S. PATENT DOCUMENTS

| | | | |
|---|---|---|---|
| 4,396,077 | 8/1983 | Radtke | 175/329 |
| 4,499,795 | 2/1985 | Radtke | 76/108 A |
| 4,567,954 | 2/1986 | Voight, III et al. | 175/393 |

*Primary Examiner*—Stephen J. Novosad
*Assistant Examiner*—Terry Lee Melius
*Attorney, Agent, or Firm*—Browning, Bushman, Zamecki & Anderson

[57] ABSTRACT

A method of manufacturing by a power metallurgy process a rotary drill bit including a bit body having an external surface on which are mounted a plurality of preform cutting elements, and an inner passage for supplying drilling fluid to at least one nozzle located in a socket at the external surface of the bit. The method includes the steps of forming a hollow mould for moulding the bit body, packing the mould with powdered material, such as tungsten carbide powder, and infiltrating the material with a metal alloy in a furnace to form a matrix. Before packing the mould with the powdered material, there is positioned in the interior surface of the mould at least one former which projects into the interior of the mould space at the desired location for a nozzle socket, the former having an external screw thread whereby the matrix material packed around the former becomes shaped with a corresponding internal screw thread. The former is so constructed that it may be removed from the bit body after formation thereof to leave in the matrix an internally threaded socket which may receive a separately formed, externally threaded nozzle. The internal threads in the socket are formed from the matrix material which surrounds and defines the socket.

9 Claims, 5 Drawing Figures

ROTARY DRILL BITS WITH NOZZLE FORMER AND METHOD OF MANUFACTURING

BACKGROUND OF THE INVENTION

The invention relates to rotary drill bits for use in drilling or coring deep holes in subsurface formations.

In particular, the invention is applicable to rotary drill bits of the kind comprising a bit body having an external surface on which are mounted a plurality of cutting elements for cutting or abrading the formation, and an inner passage for supplying drilling fluid to one or more nozzles at the external surface of the bit. The nozzles are so located at the surface of the bit body that drilling fluid emerging from the nozzles flows past the cutting elements, during drilling, so as to cool and/or clean them.

Although not essential to the present invention, the cutting elements may be in the form of so-called 'pre-form' cutting elements, being in the shape of a tablet, usually circular, having a hard cutting face formed of polycrystalline diamond or other superhard material.

In one commonly used method of making rotary drill bits of the above-mentioned type, the bit body is formed by a power metallurgy process. In this process a hollow mould is first formed, for example from graphite, in the configuration of the bit body or a part thereof. The mould is packed with powdered material, such as tungsten carbide, which is then infiltrated with a metal alloy, such as a copy alloy, in a furnace so as to form a hard matrix. (The term 'matrix' will be used herein to refer to the whole solid metallic material which results from the above process, i.e. tungsten carbide powder surrounded by solidified infiltration alloy. This is the term commonly used for such material in the drill bit industry, notwithstanding the fact that, in strict metallurgical terms, it is the infiltration alloy alone which forms a matrix, in which the tunsten carbide particles are embedded.)

If the cutting elements are of a kind which are not thermally stable at the infiltration temperature, dummy formers are normally mounted on the interior surface of the mould so as to define on the finished bit body locations where cutting elements may be subsequently mounted. Alternatively, where thermally stable cutting elements are employed, such elements may themselves be located on the interior surface of the mould so as to become mounted on the bit body during its formation.

Although the aforementioned nozzles for supplying drilling fluid to the surface of the bit body may be formed by simple holes in the matrix material communicating with the inner passage of the bit body, it is preferable for each nozzle to be a separately formed assembly which is mounted in the bit body. This enables the nozzle aperture to be accurately dimensioned and also allows the nozzle assembly to be formed from hard, erosion-resistant material or faced with such material.

When bit bodies were first manufactured from matrix, using the above-described powder metallurgy process, it was common practice for the separately formed nozzle to be permanently embedded in the bit body during formation thereof. The nozzles would be mounted at the desired locations on the interior surface of the mould, and the powder material would be packed around the nozzles before infiltration. The disadvantage of this method was that since the nozzles were permanently mounted in the bit body the diameter of the nozzle aperture was fixed once the bit had been manufactured. However, there are many different factors which determine what size of nozzle aperture will give the best performance during drilling. Accordingly, it became desirable to mount the nozzles removably in the bit body so that the appropriate size of nozzle might be selected and fitted according to the particular drilling conditions. In order to achieve this, externally threaded nozzle assemblies have been provided, which screw into internally threaded sockets provided in the bit body. Since, in order to provide the required erosion resistance, the nozzles are often formed from tungsten carbide or similar hard material which is difficult to machine, the external thread for the nozzle has usually been provided on a steel sleeve which is brazed to the carbide of the nozzle.

With conventional matrix bits, however, it is difficult simply to machine an internal screw thread within a socket in the bit body, due to the hardness of the matrix material. Accordingly, it has hitherto been the practice, in order to provide replaceable nozzles in matrix bits, to mount within the matrix an internally threaded steel sleeve into which the nozzle may subsequently be screwed. Such arrangement has the disadvantage, however, that it involves several manufacturing steps and is therefore costly. Also, the necessity of providing a steel sleeve means that the effective overall diameter of each nozzle assembly is greater than the diameter of the nozzle itself and this imposes limitations on how closely nozzles may be mounted in relation to one another and to the cutting elements on the bit body and this, in turn, imposes undesirable restrictions on the design of the bit body as a whole.

If the threaded steel sleeve is embedded in the matrix during the formation of the bit body, problems may arise due to oxidisation of the sleeve and/or fouling of its threads by matrix powder. On the other hand, if the sleeve is brazed into a socket in the matrix after the matrix has been formed, there is always the risk that, occasionally, a brazed joint will be imperfect and liable to allow leakage. Such imperfect brazed joints may be difficult to detect during the manufacturing process. If leakage does occur, the steel sleeve becomes subject to erosion at both ends, and this can, in time, even cause the sleeve to become detached from the bit body.

It is also usually necessary to provide an O-ring seal between the nozzle assembly and the steel sleeve. Normally, such a seal will prevent any leakage of drilling fluid around the nozzle assembly. However, should leakage pass the O-ring occur for any reason, such leakage will begin to erode the steel around the O-ring, so that the leakage, once begun, will rapidly get worse.

The present invention sets out to provide a rotary drill bit, and a method of manufacturing such a bit, in which the above-mentioned disadvantages may be reduced or overcome.

SUMMARY OF THE INVENTION

According to the invention there is provided a method of manufacturing by a powder metallurgy process a rotary drill bit including a bit body having an external surface on which are mounted a plurality of cutting elements, and an inner passage for supplying drilling fluid to at least one nozzle located in a socket at the external surface of the bit, the method including the steps of forming a hollow mould for moulding at least a portion of the bit body, packing at least part of the mould with powdered matrix material, and infiltrating the material with a metal alloy in a furnace to form a matrix, characterised in that the method further includes the step, before packing the mould with the powdered matrix material, of positioning on the interior surface of the mould at least one former which projects into the interior of the mould space at the desired location for a nozzle socket, the former having an external screw thread whereby the matrix material packed around the former becomes shaped with a corresponding internal screw thread, the former being so constructed that it may be removed from the bit body after formation thereof to leave in the matrix an internally threaded socket adapted to receive a separately formed, externally threaded nozzle, the internal threads in the socket being formed from the matrix material which surrounds and defines the socket.

If the matrix material defining the internal screw thread is readily machinable, it may, if necessary, also be machined to the required tolerances. Alternatively, the internal surface portion of the socket may be cylindrical, the matrix material being such that the screw thread may be entirely machines from the cylindrical socket.

There may be provided an annular sealing member between the nozzle and the internal surface portion of the socket. In this case the sealing member may be received in a peripheral annular groove around the nozzle, or a groove moulded or machined around the internal surface of the socket, the former being shaped according to the required shape of the socket.

Since the internal thread in the socket is formed in the matrix material itself, it is not necessary to provide a steel sleeve, within the socket in the matrix, to receive the nozzle. Thus the number of manufacturing steps necessary may be reduced, thus reducing the cost of manufacture of the bit. Furthermore, in the absence of a steel sleeve, the overall diameter of the nozzle assembly is limited to the diameter of the nozzle itself, thus providing greater freedom in positioning the nozzle on the bit body.

In order to provide the required characteristics in the matrix material which defines the internal surface portion of the socket, the method may comprise the successive steps of first packing around at least said external surface portion of the former a first matrix-forming material and then packing around the former and first material a second matrix-forming material. The first material may then have the characteristics enabling it to form an internal screw thread of the required fineness, whereas the second outer material may have different characteristics such as are normally required for a bit body or portion thereof.

The first material which is packed around the former may, for example, comprise metallic tungsten, iron, steel or fine tungsten carbide. The material may be applied in dry powder form or may be applied in the form of 'wet mix' comprising the powdered material with a liquid to form a paste. The liquid may be a hydrocarbon such as polyethylene glycol.

The former, or at least the outer surfacedefining portions thereof, may be formed from graphite or any other suitable material.

The invention also includes within its scope a rotary drill bit for use in drilling or coring deep holes in subsurface formations comprising a bit body having an external surface on which are mounted a plurality of cutting elements for cutting or abrading the formation, and an inner passage for supplying drilling fluid to at least one nozzle located in a socket at the external surface of the bit, at least a portion of the bit body in which a nozzle is mounted comprising a matrix material formed by a powder metallurgy process, and said nozzle being formed with an external screw thread which is in mating engagement with an internal screw thread in the corresponding socket in the bit body, the internal threads in the socket being formed from the matrix material which surrounds and defines the socket.

BRIEF DESCRIPTION OF THE DRAWINGS

FIGS. 1 and 2 show a typical full bore drill bit of the kind to which the present invention is applicable.

DETAILED DESCRIPTION OF THE PREFERRED EMBODIMENTS

Figure 1:
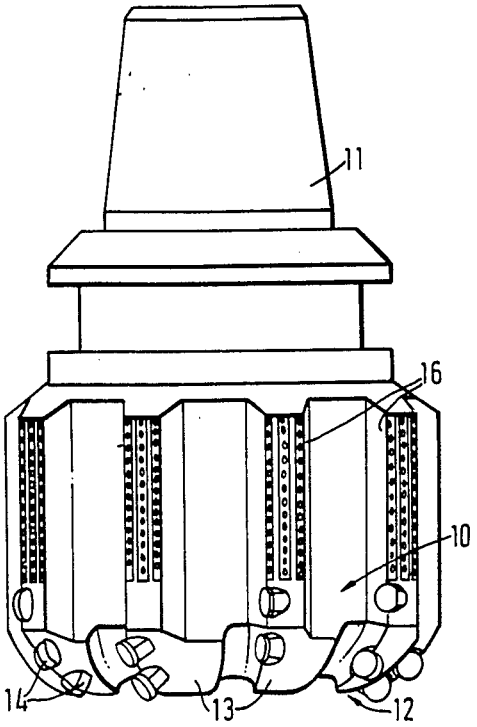
FIG. 1 is a side elevation of a typical drill bit of the kind to which the invention is applicable.
Figure 2:
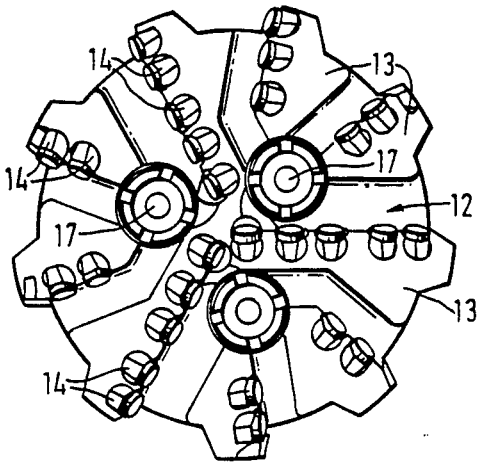
FIG. 2 is an end elevation of the drill bit shown in FIG. 1.

The bit body 10 is typically formed of tungsten carbide matrix infiltrated with a binder alloy, and has a threaded shank 11 at one end for connection to the drill string.

The operative end face 12 of the bit body is formed with a number of blades 13 radiating from the central area of the bit, and the blades carry cutting members 14 spaced apart along the length thereof.

The bit has a gauge section including kickers 16 which contact the walls of the borehole to stabilise the bit in the borehole. A central passage (not shown) in the bit body and shank delivers drilling fluid through nozzles 17 in the end face 12 in known manner to clean and/or cool the cutting members.

In the particular arrangement shown, each cutting member 14 comprises a preformed cutting element mounted on a carrier in the form of a stud which is located in a socket in the bit body. Conventionally, each perform cutting element is usually circular and comprises a thin facing layer of polycrystalline diamond bonded to a backing layer of tungsten carbide. However, it will be appreciated that this is only one example of the many possible variations of the type of bit to which the invention is applicable, including bits where each preform cutting element comprises a unitary layer of thermally stable polycrystalline diamond material. In some cases the cutting element may be mounted directly on the bit body instead of being mounted on studs.

As previously mentioned, it is desirable for the nozzles 17 to be readily removable from the bit body. In order to achieve this, each nozzle is normally in screw threaded engagement within a socket in the bit body, which socket communicates with the aforementioned central passage for drilling fluid. Slots 18 are formed in the end face of each nozzle to permit its engagement by a tool whereby the nozzle may be unscrewed.

The present invention relates to bits where at least a portion of the bit body is moulded in a powder metallurgy process. As previously mentioned, it has hitherto been the practice to embed in the bit body, at each nozzle location, an internally threaded sleeve formed from steel or some other easily machineable metal.

Figure 3:
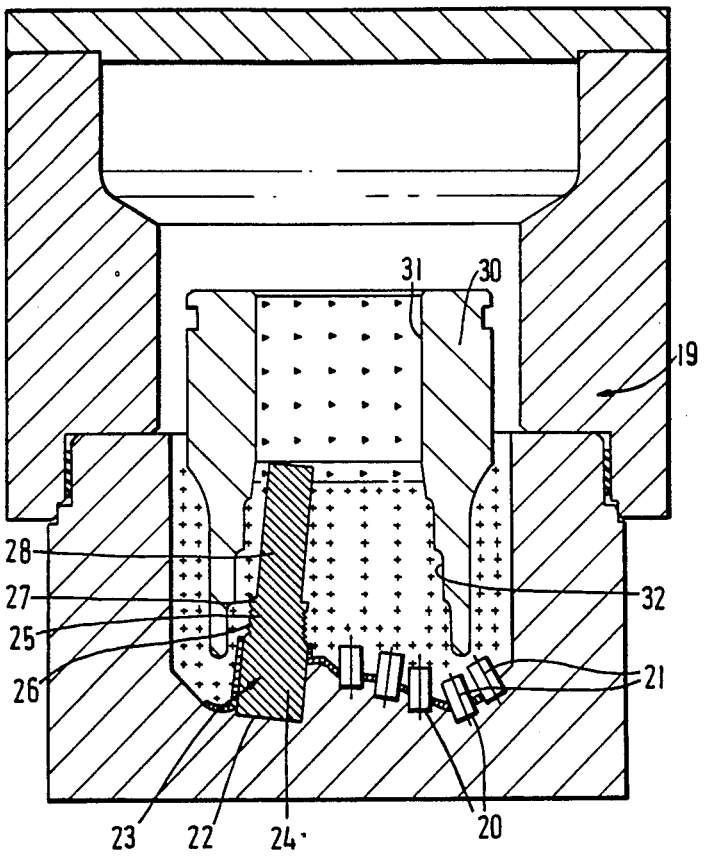
FIG. 3 is a vertical section through a mould showing the manufacture of a drill bit by the method according to the invention.

FIG. 3 illustrates a method according to the invention whereby the internally threaded socket to receive a nozzle is formed directly in matrix material.

Referring to FIG. 3, a two-part mould 19 is formed from graphite and has an internal configuration corresponding generally to the required surface shape of the bit body or a portion thereof. For example, the mould may be formed with elongate recesses corresponding to the blades 13. Spaced apart along each blade-forming recess are a plurality of circular sockets 20 each of which receives a cylindrical former 21 formed from graphite or some other suitable material, the object of the formers 21 being to define in the matrix sockets to receive the studs on which the cutting elements are mounted.

The matrix material is moulded on and within a hollow steel blank 30. The blank is supported in the mould 20 so that its outer surface is spaced from the inner surface of the mould. The blank has an upper cylindrical internal cavity 31 communicating with a lower diverging cavity 32.

According to the present invention, there is also provided in the mould 19, at each desired location for a nozzle 17, a socket 22 which receives one end of an elongated stepped cylindrical former 23 which is also formed from graphite or other suitable material and extends into the mould space within the lower cavity 32 in the hollow steel blank 30.

The former 23 (see also FIG. 4) comprises a first generally cylindrical portion 24, a second cylindrical portion 25 formed with an external screw thread 26, a third axially shorter cylindrical portion 27 formed with a peripheral groove 33 and a fourth elongate portion of smaller diameter 28.

After the formers 21 and 23 are in position, and before the steel blank 30 is inserted, the bottom of the mould and the projecting part of the portion 24 of the former 23 have applied thereto a layer of hard-matrix-forming material to form a hard facing for the end face of the drill bit, and the cylindrical mouth of the nozzle socket.

The steel blank 30 is inserted into the mould and supported with its outer surface spaced from the inner surfaces of the mould. Powdered matrix-forming material (for example, powdered tungsten carbide) is packed around the outside of the steel blank and within the lower diverging cavity 32 of the blank, and around the former 23 and the formers 21. Tungsten metal powder is then packed in the upper cavity 31 in the steel blank 30. The matrix-forming material is then infiltrated with a suitable alloy in a furnace to form the matrix, in known manner.

Figure 4:
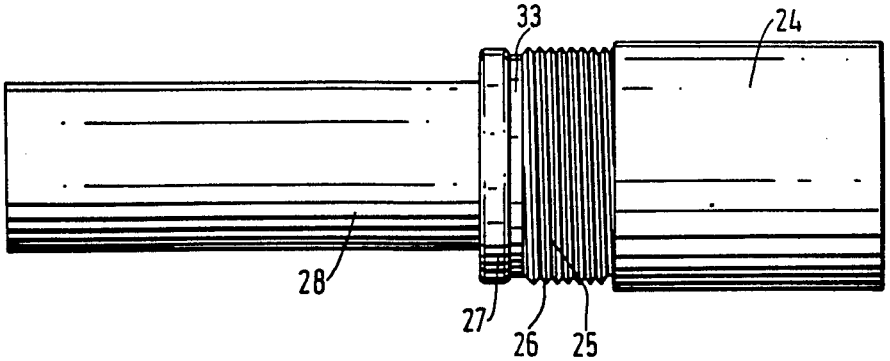
FIG. 4 is a side elevation, on a larger scale, of the former shown in FIG. 3.

After removal of the bit body from the mould, the formers 21 and 23 are removed from the bit body. Referring to FIGS. 3 and 4, the threaded portion 25 of the former 23 will have formed in the matrix within the cavity 32 of the steel blank an internal screw thread into which may be screwed the external screw thread of a removable nozzle assembly. The cylindrical portion 27 of the former adjacent the annular groove 33 forms in the matrix material a groove to receive an O-sealing ring which, in use, encircles the nozzle. The groove 33 on the former forms a corresponding peripheral projection within the socket between the O-ring groove and the internal thread to prevent the O-ring being extruded out of the socket under pressure.

The elongate portion 28 of the former 23 forms in the matrix a passage leading to the upper cavity 31 of the steel blank, which is filled with a matrix of tungsten metal. The tungsten matrix is machined to provide a central passage communicating with the individual passages leading to the nozzles.

The sockets formed in the matrix by the formers 21 receive the studs of cutting assemblies in known manner. Also, in known manner, the upper portion of the steel blank 30 is machined after formation of the bit body to form the shank of the bit.

Figure 5:
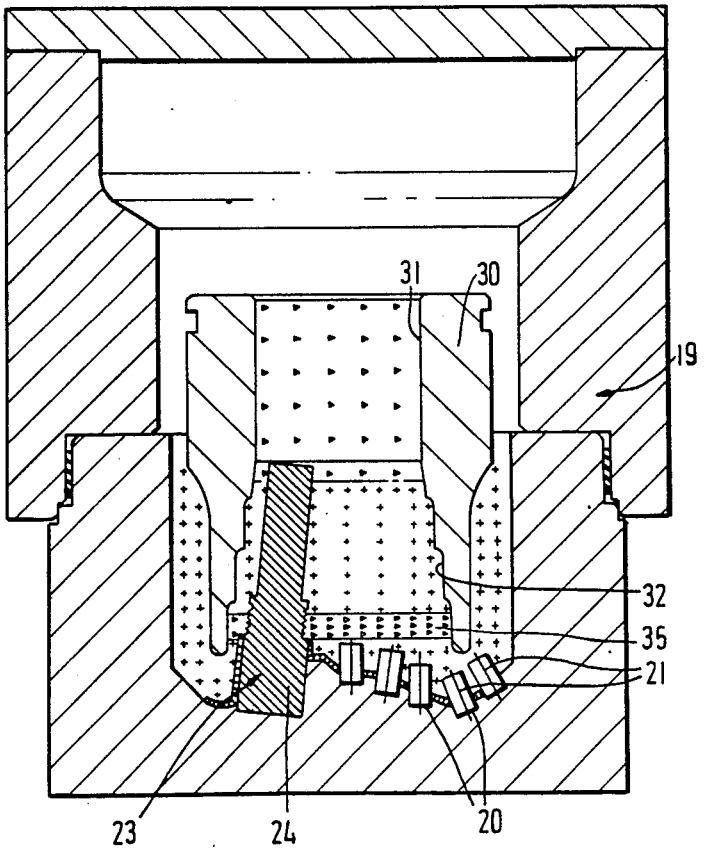
FIG. 5 shows a modified version of the arrangement shown in FIG. 3.

In the above-described arrangement the threads for receiving the nozzle are formed from the matrix material which fills substantially the whole of the lower cavity 32 of the steel blank 30. However, this is not essential and the threads could be formed in another matrix-forming material which is applied to the former 23, around the threaded portion 26, before the main part of the mould is packed with the main matrix material. For example, a layer of powdered tungsten metal, iron, steel or fine tungsten carbide could be applied around the threads 26, either as a dry powder or as a 'wet mix', before the main body of material is packed in the mould. Alternatively, a complete layer of such further matrix-forming material may be applied at the level of the thread 26, as indicated at 35 in FIG. 5. If tungsten metal or steel powder are used around the thread 26, this may allow further machining of the socket, including the thread, after formation, to achieve particular tolerances if required. It is preferred, however, that a form of powdered material be used such as to give the required fineness of thread without further machining.

If a matrix-forming powder material is used which will not form a fine thread to the required tolerances, the former 23 may be formed with a comparatively coarse thread having consolutions which are rounded in cross section, the general configuration of the threads being similar to that used in other circumstances where close tolerances are not necessary.

It will be appreciated that the former 23 may be formed from any suitable material. For example, the former could be a hollow graphite shell filled with sand or other material.

Instead of the former having a radially projecting cylindrical portion 27 to form an O-ring groove in the socket, it may be of constant diameter beyond the screw thread 26 so that the socket is not formed with an annular groove. In this case the O-ring is located in a peripheral groove around the removable nozzle.

In the above described arrangements the matrix forming material is packed around the former 23 after it has been located within the mould. In an alternative arrangement, the matrix forming powder material is applied to the former before it is located in the mould, a wrapping of metal foil, wire gauze or other suitable material being wrapped around the former to hold the powdered material closely in contact therewith. In the case of metal foil, this will melt during the matrix-forming process in the furnace so that the normal matrix material will become bonded to the powdered material surrounding the former. It is not necessary for the wire gauze to melt, if this is used, since bonding will occur through the interstices.

Although it is preferred that the O-ring seal and the screw-threaded engagement of the nozzle in the socket be used in combination, it will be appreciated that these might be used separately. For example, the O-ring seal might be used with other means of securing the nozzle within the socket, and the screw-threaded arrangement might be used with other sealing means.

I claim:

1. A method of manufacturing by a powder metallurgy process a rotary drill bit including a bit body having an external surface on which are mounted a plurality of cutting elements, and an inner passage for supplying drilling fluid to at least one nozzle located in a socket at the external surface of the bit, the method including the steps of forming a hollow mould for moulding at least a portion of the bit body, positioning on the interior surface of the mould at least one former which projects into the interior of the mould space at the desired location for a nozzle socket, the former having an external screw thread, packing around at least the externally threaded portion of the former a first matrix-forming material, packing around the former and first material a second matrix-forming material, the second matrix-forming material being a powdered material filling at least part of the mould, and infiltrating the matrix-forming materials with a metal alloy in a furnace to form a matrix, whereby the first matrix-forming material packed around the former becomes shaped with a corresponding internal screw thread, the former being so constructed that it may be removed from the bit body after formation thereof to leave in the matrix an internally threaded socket adapted to receive a separately formed, externally threaded nozzle, the internal threads in the socket being formed from the first matrix-forming material, the first matrix-forming material having characteristics enabling it to form an internal screw thread of the required fineness and the second outer matrix-forming material having different characteristics such as are normally required for a bit body.

2. A method according to claim 1, wherein the first material is of a kind which may be readily machined, and wherein the method includes the further step of machining the threaded socket to the required tolerances after formation of the bit body.

3. A method according to claim 1, wherein the first material which is packed around the former is selected from metallic tungsten, steel and fine tungsten carbide.

4. A method according to claim 3, wherein the first material is applied in dry powder form.

5. A method according to claim 3, wherein the first material is applied in the form of 'web mix' comprising the powdered material mixed with a liquid to form a paste.

6. A method according to claim 5, wherein said liquid is a hydrocarbon.

7. A method according to claim 6, wherein said liquid is polyethylene glycol.

8. A method of manufacturing by a powder metallurgy process a rotary drill bit including a bit body having an external surface on which are mounted a plurality of cutting elements, and an inner passage for supplying drilling fluid to at least one nozzle located in a socket at the external surface of the bit, the method including the steps of forming a hollow mould for moulding at least a portion of the bit body, positioning on the interior surface of the mould at least one former which projects into the interior of the mould space at the desired location for a nozzle socket, the former having an external cylindrical portion, packing around at least the external cylindrical portion of the former a first matrix-forming material, packing around the former and first material a second matrix-forming material, the second matrix-forming material being a powdered material filling at least part of the mould, and infiltrating the matrix-forming materials with a metal alloy in a furnace to form a matrix, whereby the first matrix-forming material packed around the former becomes shaped with a corresponding internal cylindrical portion, the former being so constructed that it may be removed from the bit body after formation thereof to leave in the matrix a socket adapted to receive a separately formed nozzle, the internal cylindrical portion of the socket being formed from the first matrix-forming material, the nature of the first matrix-forming material being such that the matrix formed therefrom may be readily machined, and the second matrix-forming material having different characteristics such as are normally required for a bit body, the method including the further step of machining an internal screw thread in said internal cylindrical portion, whereby the separately formed nozzle may be retained within the socket by engagement of said internal screw thread by a corresponding external screw thread on the nozzle.

9. A method of manufacturing by a powder metallurgy process a rotary drill bit including a bit body having an external surface on which are mounted a plurality of cutting elements, and an inner passage for supplying drilling fluid to at least one nozzle located in a socket at the external surface of the bit, the method including the steps of forming a hollow mould for moulding at least a portion of the bit body, positioning on the interior surface of the mould at least one former which projects into the interior of the mould space at the desired location for a nozzle socket, the former having an external screw thread, packing around at least the externally threaded portion of the former a first matrix-forming material in the form of "wet mix" comprising powdered material mixed with a liquid to form a paste, packing around the former and first material a second matrix-forming material, the second matrix-forming material being a powdered material filling at least part of the mould, and infiltrating the matrix-forming materials with a metal alloy in a furnace to form a matrix, whereby the first matrix-forming material packed around the former becomes shaped with a corresponding internal screw thread, the former being so constructed that it may be removed from the bit body after formation thereof to leave in the matrix an internally threaded socket adapted to receive a separately formed, externally threaded nozzle, the internal threads in the socket being formed from the first matrix-forming material.

* * * * *

UNITED STATES PATENT AND TRADEMARK OFFICE

CERTIFICATE OF CORRECTION

PATENT NO. : 4,694,919

DATED : September 22, 1987

INVENTOR(S) : John D. Barr

It is certified that error appears in the above—identified patent and that said Letters Patent is hereby corrected as shown below:

In Column 7, line 46, delete "web" and insert therefor --wet--.

Signed and Sealed this

Twenty-second Day of March, 1988

*Attest:*

DONALD J. QUIGG

*Attesting Officer*

*Commissioner of Patents and Trademarks*